US007673779B2

(12) United States Patent
Moeller et al.

(10) Patent No.: US 7,673,779 B2
(45) **Date of Patent: *Mar. 9, 2010**

(54) COMBUSTION CHAMBER DISTANCE CONTROL COMBUSTION-POWERED FASTENER-DRIVING TOOL

(75) Inventors: Larry M. Moeller, Schaumburg, IL (US); Hanxin Zhao, Northbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 17 days.

This patent is subject to a terminal disclaimer.

(21) Appl. No.: 11/601,207

(22) Filed: Nov. 17, 2006

(65) Prior Publication Data

US 2007/0131731 A1 Jun. 14, 2007

Related U.S. Application Data

(63) Continuation-in-part of application No. 11/028,432, filed on Jan. 3, 2005, now Pat. No. 7,487,898.

(60) Provisional application No. 60/543,053, filed on Feb. 9, 2004.

(51) Int. Cl.
*B25C 1/04* (2006.01)

(52) U.S. Cl. ..... 227/10; 227/8; 227/130; 123/46 SC

(58) Field of Classification Search ..... 227/8, 227/10, 130; 123/46 SC
See application file for complete search history.

(56) References Cited

U.S. PATENT DOCUMENTS 4,403,722 A 9/1983 Nikolich
4,483,473 A 11/1984 Wagdy
4,483,474 A 11/1984 Nikolich
4,522,162 A 6/1985 Nikolich
RE32,452 E 7/1987 Nikolich
5,133,329 A 7/1992 Rodseth et al.
5,197,646 A 3/1993 Nikolich
5,213,247 A 5/1993 Gschwend et al.
5,263,439 A 11/1993 Doherty et al.
5,713,313 A * 2/1998 Berry ..... 123/46 SC
5,909,836 A * 6/1999 Shkolnikov et al. ..... 227/8
6,145,724 A 11/2000 Shkolnikov et al.
6,425,354 B1 7/2002 Buchel et al.

(Continued)

*Primary Examiner*—Rinaldi I. Rada
*Assistant Examiner*—Michelle Lopez
(74) *Attorney, Agent, or Firm*—Greer, Burns & Crain, Ltd.; Christopher P. Rauch; Mark W. Croll

(57) ABSTRACT

A combustion-powered fastener-driving tool includes a combustion-powered power source including a cylinder head and a combustion chamber defined by the cylinder head, a valve sleeve and an upper surface of a reciprocating piston, the valve sleeve reciprocable relative to the cylinder head between a rest position and a pre-firing position. The valve sleeve has a range of positions between a first sealing position in which the combustion chamber is closed, and said pre-firing position in which the valve sleeve is prevented from further movement. A lockout device is associated with the power source and has an actuated position configured for preventing the reciprocation of the valve sleeve beyond the first sealed position to open the combustion chamber, but permitting movement of the valve sleeve from the first sealed position to the pre-firing position until the piston returns to a piston pre-firing position post combustion.

11 Claims, 8 Drawing Sheets

U.S. PATENT DOCUMENTS 6,460,507 B2 10/2002 Thieleke et al.
6,526,926 B1 3/2003 Towfighi
6,666,366 B2 12/2003 Rosenbaum et al.
6,783,045 B2 * 8/2004 Shima et al. ..... 227/8
6,889,885 B2 * 5/2005 Ohmori ..... 227/10
6,971,568 B2 * 12/2005 Schiestl et al. ..... 227/8
7,284,511 B2 * 10/2007 Zahner et al. ..... 123/46 H
2005/0173484 A1 8/2005 Moeller et al.
2005/0247749 A1 11/2005 Wywialowski et al.
2006/0102111 A1 5/2006 Ohmori et al.

* cited by examiner

COMBUSTION CHAMBER DISTANCE CONTROL COMBUSTION-POWERED FASTENER-DRIVING TOOL

RELATED APPLICATION

This application is a Continuation-In-Part of U.S. Ser. No. 11/028,432 filed Jan. 3, 2005 now U.S. Pat. No. 7,487,898 entitled: COMBUSTION CHAMBER CONTROL FOR COMBUSTION-POWERED FASTENER-DRIVING TOOL, which claims priority under 35 USC § 120 from U.S. Ser. No. 60/543,053, filed Feb. 9, 2004.

BACKGROUND

The present invention relates generally to fastener-driving tools used to drive fasteners into workpieces, and specifically to combustion-powered fastener-driving tools, also referred to as combustion tools or combustion nailers. The invention is specifically directed towards lockout devices for retaining the combustion chamber of such combustion tools closed pending return of the piston to a prefiring position.

Combustion-powered tools are known in the art. Representative tools are manufactured by Illinois Tool Works, Inc. of Glenview, Ill. for use in driving fasteners into workpieces, and are described in commonly assigned patents to Nikolich U.S. Pat. Re. No. 32,452, and U.S. Pat. Nos. 4,522,162; 4,483,473; 4,483,474; 4,403,722; 5,133,329; 5,197,646; 5,263,439 and 6,145,724 all of which are incorporated by reference herein.

Such tools incorporate a tool housing enclosing a small internal combustion engine or power source. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: mixing the fuel and air within the chamber; turbulence to increase the combustion process; scavenging combustion by-products with fresh air; and cooling the engine. The engine includes a reciprocating piston with an elongated, rigid driver blade disposed within a cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position, through differential gas pressures within the cylinder. Fasteners are fed magazine-style into the nosepiece, where they are held in a properly positioned orientation for receiving the impact of the driver blade. Upon ignition of the combustible fuel/air mixture, the combustion in the chamber causes the acceleration of the piston/driver blade assembly and the penetration of the fastener into the workpiece if the fastener is present.

Traditionally, combustion-powered tools have been designated as sequentially operated. In other words, the tool must be pressed against the workpiece, collapsing the workpiece contact element (WCE) before the trigger is pulled for the tool to fire or drive a nail. This contrasts with pneumatic tools, which can be fired or activated in a repetitive cycle operational format. In other words, the latter tools will fire repeatedly by pressing the tool against the workpiece, if the trigger is held in the depressed mode. These differences manifest themselves in the number of fasteners that can be fired per second for each style tool and for each mode of operation. Another aspect of sequential operation of combustion nailers is that only after a valve sleeve position switch, commonly referred to as a "chamber switch" and a trigger switch have been closed in the order mentioned and then opened, will a subsequent engine cycle be permitted. Such an operational control, described in U.S. Pat. No. 5,133,329, incorporated by reference, prevents unwanted ignition or other tool feature operations, such as electronic fuel injection (EFI), in instances when both switches remain closed after an engine cycle is complete.

One distinguishing feature that limits combustion-powered tools to sequential operation is the manner in which the drive piston is returned to the initial position after the tool is fired. Combustion-powered tools utilize self-generative vacuum to perform the piston return function. Piston return of the vacuum-type requires significantly more time than that of pneumatic tools that use positive air pressure from the supply line for piston return.

With combustion-powered tools of the type disclosed in the patents incorporated by reference above, by firing rate and control of the valve sleeve the operator controls the time interval provided for the vacuum-type piston return. The formation of the vacuum occurs following the combustion of the mixture and the exhausting of the high-pressure burnt gases. With residual high temperature gases in the tool, the surrounding lower temperature aluminum components cool and collapse the gases, thereby creating a vacuum. In many cases, such as in trim applications, the operator's cycle rate is slow enough that vacuum return works consistently and reliably.

However, for those cases where a tool is operated at a much higher cycle rate, the operator can open the combustion chamber during the piston return cycle by removing the tool from the workpiece. This causes the vacuum to be lost and piston travel will stop before reaching the top of the cylinder. This leaves the driver blade in the guide channel of the nosepiece, thereby preventing the nail strip from advancing. The net result is no nail in the firing channel and no nail fired in the next cycle.

To assure adequate closed combustion chamber dwell time in the sequentially-operated combustion tools identified above, a chamber lockout device is linked to the trigger. This mechanism holds the combustion chamber closed until the operator releases the trigger. This extends the dwell time (during which the combustion chamber is closed) by taking into account the operator's relatively slow musculature response time. In other words, the physical release of the trigger consumes enough time of the firing cycle to assure piston return. The mechanism also maintains a closed chamber in the event of a large recoil event created, for example, by firing into hard wood or on top of another nail. It is disadvantageous to maintain the chamber closed longer than the minimum time to return the piston, as cooling and purging of the tool is prevented.

Commonly-assigned U.S. Pat. No. 6,145,724 describes a cam mechanism that is operated by the driver blade to prevent premature opening of the combustion chamber prior to return of the piston/driver blade to the pre-firing position (also referred to as pre-firing). The main deficiency of this approach is that the piston requires the use of a manual reset rod to return the piston to pre-firing if the piston does not fully return due to a nail jam or perhaps a dirty/gummy cylinder wall. A piston that does not return will cause the chamber to remain closed; therefore the tool cannot be fired again.

Another type of lockout device for combustion-powered tools is disclosed in U.S. Pat. No. 6,783,045, in which a reciprocating solenoid locking device is used to restrain the valve sleeve in the sealed position to hold the combustion chamber sealed for a predetermined amount of time during which the piston should return. It has been found that the preferred embodiment of the '045 patent requires precise spatial component relationships and corresponding timing of operations to be satisfied for reliable operation between the retractable solenoid and the mating shoulders or apertures on the valve sleeve. Such precision is difficult to maintain when mass producing the tools. Furthermore, the stressful operational environment of such tools enhances the potential for combustion-induced shock forces to damage the solenoid lockout mechanism.

Thus, there is a need for an improved combustion-powered fastener-driving tool which is capable of operating in a repetitive cycle mode. There is also a need for an improved combustion-powered fastener-driving tool which can address the special needs of delaying the opening of the combustion chamber to achieve complete piston return in a repetitive cycle mode. There is also a need for a lockout device which accommodates manufacturing-induced deviations and tolerances.

BRIEF SUMMARY

The above-listed needs are met or exceeded by the present combustion-powered fastener-driving tool which overcomes the limitations of the current technology. Among other things, the present tool incorporates an electromechanical device configured for managing the combustion chamber in a sealed position for a specific time duration, resulting in reliable vacuum return of the piston. To accommodate manufacturing tolerance variations and to reduce shock-induced damage, the lockout device is positioned in the tool to allow for relative movement of the valve sleeve without causing opening of the combustion chamber. The lockout device also accommodates overtravel of the valve sleeve past the point at which the combustion chamber is sealed. Relative distances of valve sleeve overtravel, lockout device location and chamber switch actuation range are all coordinated to allow for the desired tolerances and movement of the valve sleeve while maintaining the combustion chamber in a closed position.

In the preferred embodiment, the lockout device is an electromagnetic latch connected to the tool and the valve sleeve that holds the valve sleeve in a closed position when the electromagnet is energized. A magnetic plate is moved into contact with the electromagnet by a bracket attached to the valve sleeve. When the electromagnet is energized it attracts the magnet plate, preventing the valve sleeve from retracting. Once the electromagnet is de-energized, the valve sleeve retracts and moves to the open position, drawing the magnetic plate away from the electromagnet. The lockout device provides for overtravel of the valve sleeve while still preventing the valve sleeve from breaking the vacuum seal and opening the combustion chamber.

More specifically, a combustion-powered fastener-driving tool includes a combustion-powered power source including a cylinder head and a combustion chamber defined by the cylinder head, a cylinder, a valve sleeve and an upper surface of a reciprocating piston, the valve sleeve reciprocable relative to the cylinder head between a rest position and a pre-firing position. The valve sleeve has a range of positions between a first sealing position in which the combustion chamber is closed, and said pre-firing position in which the valve sleeve is prevented from further movement. A lockout device is associated with the power source and has an actuated position configured for preventing the reciprocation of the valve sleeve beyond the first sealed position to open the combustion chamber, but permitting movement of the valve sleeve from the first sealed position to the pre-firing position until the piston returns to a piston pre-firing position post combustion.

In another embodiment, a combustion-powered fastener-driving tool includes a combustion-powered power source having a combustion chamber defined by a cylinder head, a cylinder, a valve sleeve and an upper surface of a reciprocating piston. A valve sleeve is reciprocable relative to -the cylinder head between a rest position and a pre-firing position, the valve sleeve having a range of sealed positions between a first sealing position and the pre-firing position. A lockout device is configured for automatically preventing the reciprocation of the valve sleeve beyond a sealed position until said piston returns to a piston pre-firing position, the lockout device including an electromagnet secured to the tool relative to the combustion power source. A magnetic plate is connected to and movable with the valve sleeve relative to the electromagnet, the magnetic plate is associated with and slidable relative to the valve sleeve so that movement of the valve sleeve toward the pre-firing position is accommodated after engagement of the magnetic plate with the electromagnet.

In yet another embodiment, a combustion-powered fastener-driving tool includes a combustion-powered power source, a valve sleeve reciprocable relative to the power source between a rest position and a pre-firing position, the valve sleeve having a distance $d_3$ between a first sealing position where the valve sleeve engages combustion chamber seals, and the pre-firing position. The tool also has a chamber switch activated by the movement of the valve sleeve and having a distance $d_1$ between an open, or rest position and a closed, or actuated position. A lockout device is configured for automatically preventing the reciprocation of the valve sleeve beyond a predetermined distance $d_2$ while the lockout device is actuated and a combustion chamber is sealed, and wherein $d_1$ is less than $d_2$ which is less than $d_3$.

DETAILED DESCRIPTION

Figure 1:
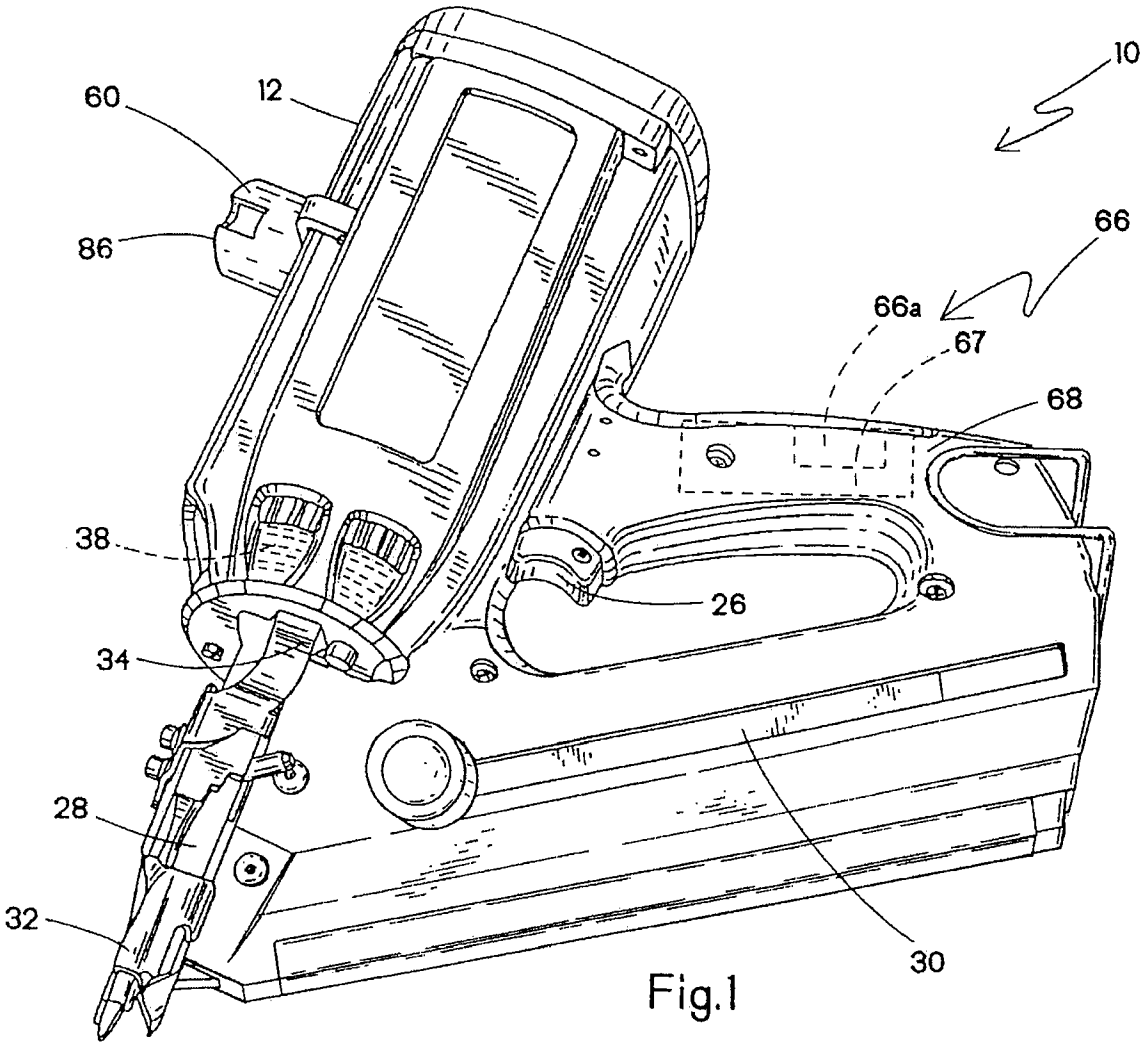
FIG. 1 is a front perspective view of a fastener-driving tool incorporating the present lockout system.
Figure 2:
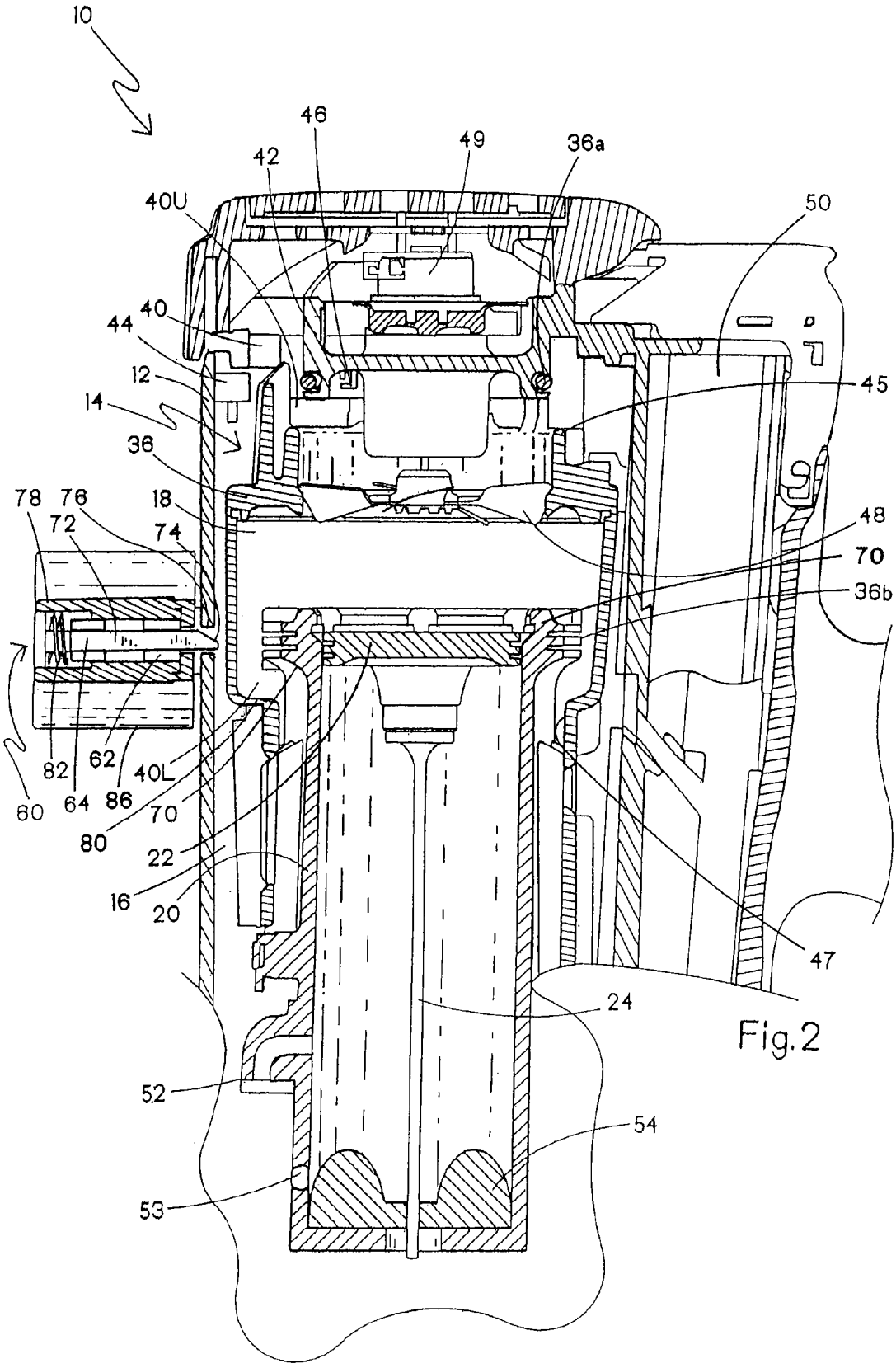
FIG. 2 is a fragmentary vertical cross-section of the tool of FIG. 1 shown in the rest position.

Referring now to FIGS. 1 and 2, a combustion-powered fastener-driving tool incorporating the present invention is generally designated 10 and preferably is of the general type described in detail in the patents listed above and incorporated by reference in the present application. A housing 12 of the tool 10 encloses a self-contained internal power source 14 (FIG. 2) within a housing main chamber 16. As in conventional combustion tools, the power source 14 is powered by internal combustion and includes a combustion chamber 18 that communicates with a cylinder 20. A piston 22 reciprocally disposed within the cylinder 20 is connected to the upper end of a driver blade 24. As shown in FIG. 2, an upper limit of the reciprocal travel of the piston 22 is referred to as a piston pre-firing position, which occurs just prior to firing, or the ignition of the combustion gases which initiates the downward driving of the driver blade 24 to impact a fastener (not shown) to drive it into a workpiece.

Through depression of a trigger 26 and actuation of an associated trigger switch (not shown, the terms trigger and trigger switch are used interchangeably), a user induces combustion within the combustion chamber 18, causing the driver blade 24 to be forcefully driven downward through a nosepiece 28 (FIG. 1). The nosepiece 28 guides the driver blade 24 to strike a fastener that had been delivered into the nosepiece via a fastener magazine 30.

Included in the nosepiece 28 is a workpiece contact element 32, which is connected, through a linkage or upper probe 34 to a reciprocating valve sleeve 36, which partially defines the combustion chamber 18. Depression of the tool housing 12 against a workpiece (not shown) in a downward direction as seen in FIG. 1 (other operational orientations are contemplated as are known in the art), causes the workpiece contact element 32 to move relative to the tool housing 12 from a rest position to a pre-firing position. This movement overcomes the normally downward biased orientation of the workpiece contact element 32 caused by a spring 38 (shown hidden in FIG. 1). It is contemplated that the location of the spring 38 may vary to suit the application, and locations displaced farther from the nosepiece 28 are envisioned.

Through the linkage 34, the workpiece contact element 32 is connected to, or in contact with, and reciprocally moves with, the valve sleeve 36. In the rest position (FIG. 2), the combustion chamber 18 is not sealed, since there is an annular gap 40 including an upper gap 40U separating the valve sleeve 36 and a cylinder head 42, which accommodates a spark plug 46, and a lower gap 40L separating the valve sleeve and the cylinder 20. A chamber switch 44 (sometimes referred to as a head switch) is located in proximity to the valve sleeve 36 to monitor its positioning. In the present tool 10, the cylinder head 42 also is the mounting point for a cooling fan 48 and a fan motor 49 powering the cooling fan. In the rest position depicted in FIG. 2, the tool 10 is disabled from firing because the combustion chamber 18 is not sealed at the top with the cylinder head 42, and the chamber switch 44 is open.

Under sequential operation, firing is enabled when a user presses the workpiece contact element 32 against a workpiece. This action overcomes the biasing force of the spring 38, causes the valve sleeve 36 to move upward relative to the housing 12, closing the gaps 40U and 40L and sealing the combustion,chamber 18 until the chamber switch 44 is activated. An upper end 45 and a lower end 47 of the valve sleeve 36 forms two circular seats which engage combustion seals 36*a* and 36*b*, preferably an O-ring but other types of sliding seals are contemplated. This operation also induces a measured amount of fuel to be released into the combustion chamber 18 from a fuel canister 50 (shown in fragment).

Figures 3, 3A:
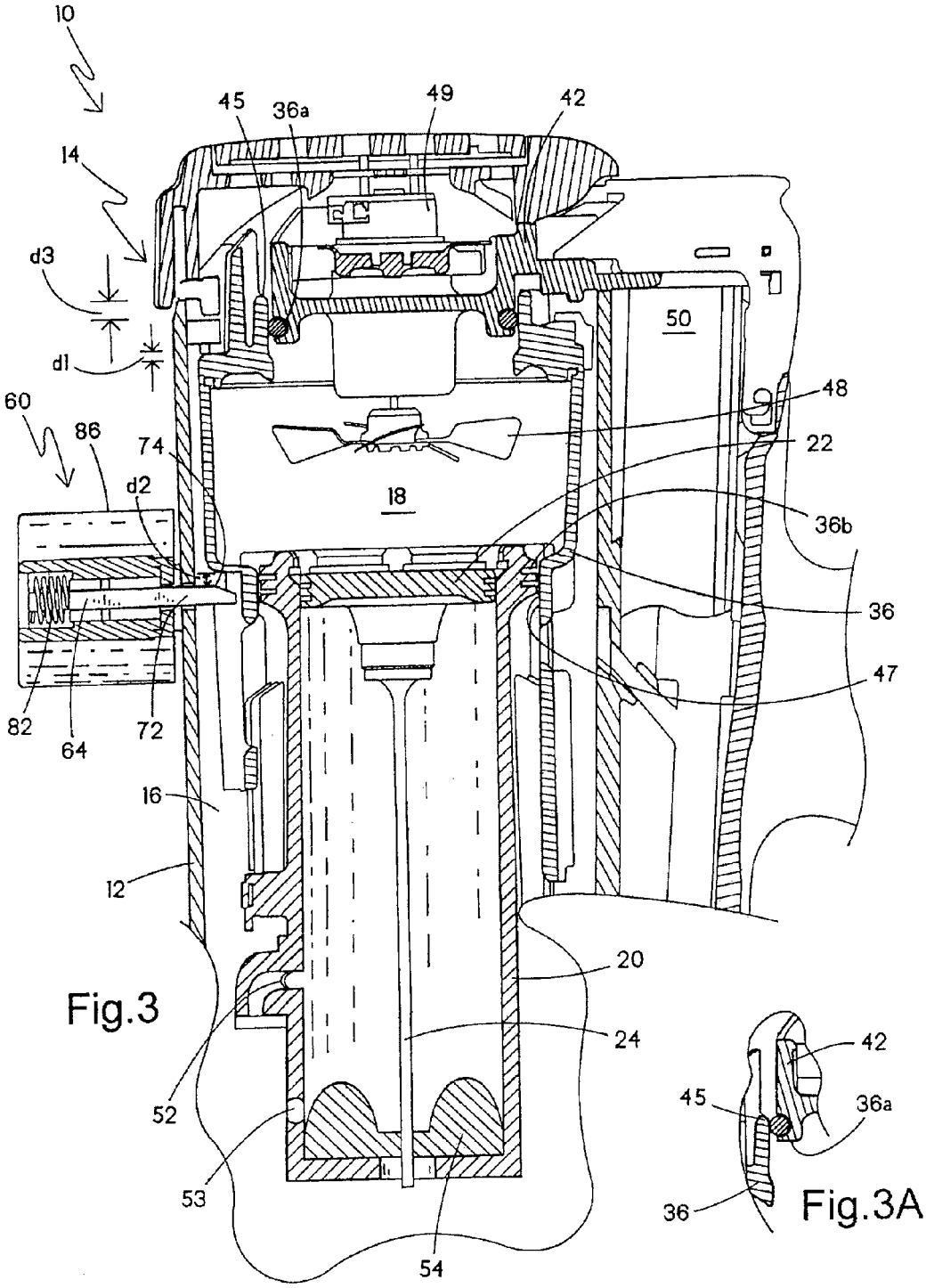
FIG. 3 is a fragmentary vertical cross-section of the tool of FIG. 2 shown in the pre-firing position.
FIG. 3A is a fragmentary vertical cross section of the tool of FIG. 3 shown in the first seal position.

As the valve sleeve 36 progresses towards the cylinder head 42, the upper end 45 moves past a first seal position (FIG. 3A) at which point the combustion seals 36*a* and 36*b* are engaged by the upper end 45 and the lower end 47 of the valve sleeve 36, and the combustion chamber 18 is sealed, further progression actuates the chamber switch 44, and ultimately the valve sleeve reaches an upper limit of its travel, referred to as a pre-firing position (FIG. 3). In other words, the valve sleeve 36 is designed to have a certain specified amount of overtravel after the combustion chamber 18 is sealed. Among other things, this overtravel allows for a wide operational range of the valve sleeve 36, a lockout device and the chamber switch 44, and positive combustion chamber sealing during tool recoil.

Upon pulling the trigger 26, the spark plug 46 is energized, igniting the fuel and air mixture in the combustion chamber 18 and sending the piston 22 and the driver blade 24 downward toward the waiting fastener for entry into the workpiece. As the piston 22 travels down the cylinder, it pushes a rush of air which is exhausted through at least one petal or check valve 52 and at least one vent hole 53 located beyond piston displacement (FIG. 2). At the bottom of the piston stroke or the maximum piston travel distance, the piston 22 impacts a resilient bumper 54 as is known in the art. With the piston 22 beyond the exhaust check valve 52, high pressure gasses vent from the cylinder 20 until near atmospheric pressure conditions are obtained and the check valve 52 closes. Due to internal pressure differentials in the cylinder 20, the piston 22 is returned to the pre-firing or rest position shown in FIG. 2.

As described above, one of the issues confronting designers of combustion-powered tools of this type is the need for a rapid return of the piston 22 to the piston pre-firing position and improved control of the chamber 18 prior to the next cycle. This need is especially important if the tool is to be fired in a repetitive cycle mode, where an ignition occurs each time the workpiece contact element 32 is retracted, and during which time the trigger 26 is continually held in the pulled or squeezed position, and the actual ignition is activated by closing of the chamber switch 44.

Referring now to FIG. 2, to accommodate these design concerns, the present tool 10 preferably incorporates a chamber lockout device, generally designated 60 and configured for preventing the reciprocation of the valve sleeve 36 from the closed or pre-firing position until the piston 22 returns to the piston pre-firing position. While discussed generally below, the lockout device 60 is disclosed in greater detail in co-pending U.S. application Ser. No. 10/838,614, filed May 4, 2004, US Patent Application Publication 2005/0247749A1 which is incorporated by reference. This holding, delaying or locking function of the lockout device 60 is operational for a specified period of time required for the piston 22 to return to the piston pre-firing position. Thus, the user using the tool 10 in a repetitive cycle mode can lift the tool from the workpiece where a fastener was just driven, and begin to reposition the tool for the next firing cycle while the combustion chamber 18 temporarily remains sealed.

Due to the shorter firing cycle times inherent with repetitive cycle operation, the lockout device 60 ensures that the combustion chamber 18 will remain sealed, and the differential gas pressures maintained so that the piston 22 will be returned before a premature opening of the chamber 18, which would normally interrupt piston return. With the present lockout device 60, the piston 22 return and subsequent opening of the combustion chamber 18 can occur while the tool 10 is being moved toward the next workpiece location.

More specifically, and while other types of lockout devices are contemplated and are disclosed in the co-pending application Ser. No. 10/838,614 incorporated by reference, the exemplary lockout device 60 includes an electromagnet 62 configured for engaging a sliding cam or latch 64 which transversely reciprocates relative to valve sleeve 36 for preventing the movement of the valve sleeve 36 for a specified amount of time. This time period is controlled by a control system 66 (FIG. 1) provided with a control program 66*a* embodied in a central processing unit or control module 67 (shown hidden), typically a microprocessor or equivalent circuit housed in a handle portion 68 (FIG. 1) of the housing 12, as is well known in the art. While other orientations are contemplated, in the depicted embodiment, the electromagnet 62 is coupled with the sliding latch 64 and positioned such that the axis of the latch is transverse to the driving motion of the tool 10. The lockout device 60 is mounted in operational relationship to an upper portion 70 of the cylinder 20 so that sliding legs or cams 72 of the latch 64 having angled ends 74 pass through apertures 76 in a mounting bracket 78 and the housing 12 to engage a recess or shoulder 80 in the valve sleeve 36 once it has reached the pre-firing position. The latch 64 is biased to the locked position by a spring 82 and is retained by the electromagnet 62 for a specified time interval.

For the proper operation of the lockout device 60, the control system 66 is configured so that the electromagnet 62 is energized for the proper period of time to allow the piston 22 to return to the piston pre-firing position subsequent to firing. More specifically, when the control system 66, triggered by an operational sequence of switches (not shown) indicates that conditions are satisfactory to operate a combustion cycle, the electromagnet 62 is energized by the control program 66*a* for approximately 100 msec. During this event, the latch 64 is actuated and held in an extended position, thereby preventing the chamber 18 from opening. The period of time of energization of the electromagnet 62 would be such that enough dwell is provided to satisfy all operating conditions for full piston return. This period may vary to suit the application.

The control system 66 is configured so that once the piston 22 has returned to the pre-firing position; the electromagnet 62 is de-energized and via sliding latch 64, the spring 38 will overcome the force of the spring 82, and any residual force of the electromagnet 62, and will cause the valve sleeve 36 to move to the rest or extended position, opening up the combustion chamber 18 and the gaps 40U, 40L. This movement is facilitated by the shoulder 80 of the valve sleeve 36 acting on the cammed surfaces 74 of the legs 72, thereby retracting the sliding latch 64. As is known, the valve sleeve 36 must be moved away from the fan 48 to open the chamber 18 for exchanging gases in the combustion chamber and preparing for the next combustion.

In the preferred embodiment, a cover 86 encloses the spring 82, the latch member 64 and the electromagnet 62, and secures these items to the mounting bracket 78 through the use of eyelets and suitable threaded fasteners, rivets or other fasteners known in the art (not shown). While in FIGS. 1-3 the electromagnet 62 is shown on a front of the housing 12, it is contemplated that it can be located elsewhere on the tool 10 or within the housing 12 as desired.

It has been noted that a drawback of the tool disclosed in U.S. Pat. No. 6,783,045 is that the lockout solenoid is subject to damage with repeated use resulting from combustion cycle induced shock, more specifically from shock transmitted during piston and bumper impact. Further, by positioning the solenoid unit to hold the valve sleeve at its uppermost position, unrepeatable operation of the lockout solenoid prevents positive sealing of the combustion chamber, thereby negatively allowing for full piston return in some circumstances. Accordingly, it has been found that satisfactory piston return is accomplished while reducing such shock damage by repositioning the lockout device 60 to create a clearance or play between it and the valve sleeve 36. As seen in FIG. 3, the lockout device 60 is positioned on the housing 12 relative to the power source 14 to engage the shoulder 80 upon the valve sleeve 36 reaching the first sealed position, and permitting movement of the valve sleeve from the first sealed position to the pre-firing position.

Thus, upon energization or actuation of the lockout device 60, the valve sleeve 36 is prevented from movement away from the cylinder head 42 which would open the combustion chamber 18, but is permitted movement in an upward direction towards the cylinder head from the first sealed position to the pre-firing position. With this configuration, despite the actuation of the lockout device 60, the valve sleeve 36 is permitted vertical play while the combustion chamber 18 remains sealed. In this manner, piston return is facilitated without subjecting the lockout device 60 to the full shock induced by the combustion cycle, more specifically the loads transmitted throughout the tool when the piston 22 impacts the bumper 54.

Figure 4:
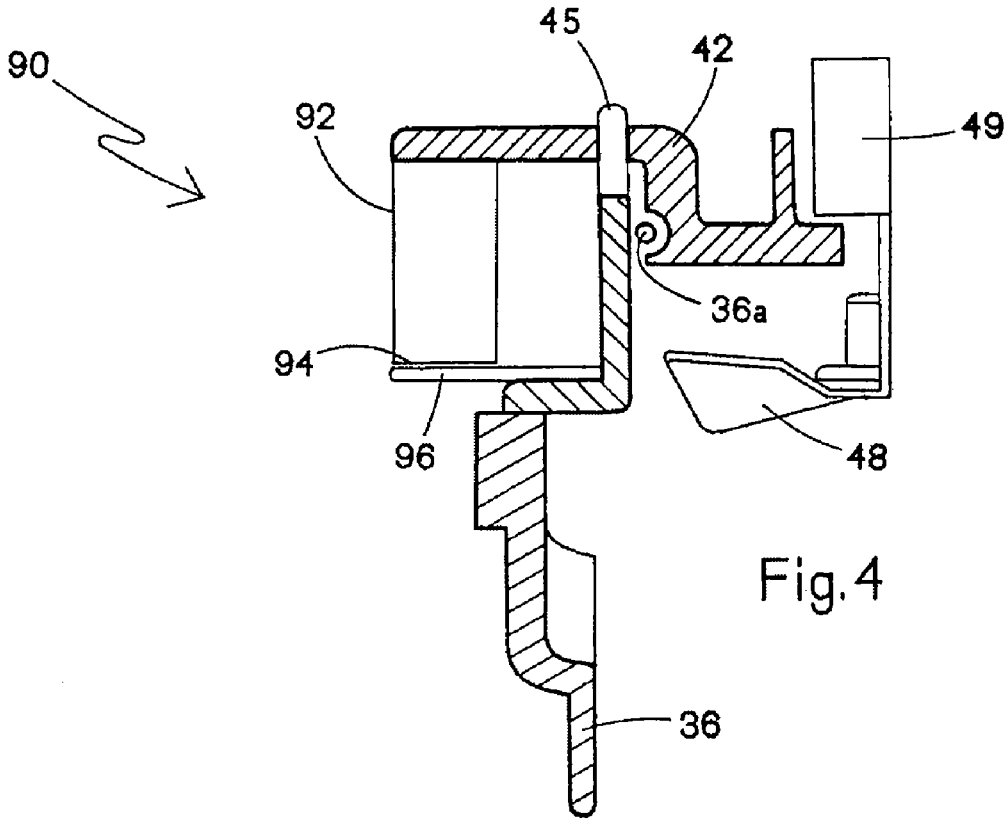
FIG. 4 is a schematic elevation of an alternate embodiment of the lockout system of FIG. 1 using an electromagnetic device.

Referring now to FIG. 4, an alternate embodiment to the lockout device 60 is generally designated 90. Shared components with the embodiment of FIGS. 1-3 are designated with identical reference numbers. A main distinction of the embodiment 90 is that the delay of the opening of the valve sleeve 36 during the combustion cycle is obtained through an electromagnetic device 92 mounted to a fixed position on the tool 10, such as the power source 14, and preferably the cylinder head 42, however other locations are contemplated. It will be seen that the electromagnetic device 92 operates along an axis which is parallel to the direction of reciprocation of the piston 22 and the valve sleeve 36. As is the case with the electromagnet 62, the device 92 is connected to the control program 66*a*. The electromagnetic device 92 depends from the cylinder head 42 so that a contact end 94 is in operational relationship to the valve sleeve 36.

In the present embodiment, the valve sleeve 36 is provided with at least one radially projecting contact formation 96 constructed and arranged to be in registry with the contact end 94 of the device 92. While in the preferred version of this embodiment the contact formation 96 is shaped as a plate, also referred to as a magnetic plate, the number, shape and positioning of the contact formation may vary to suit the application, as long as there is a sufficient magnetic attraction between the electromagnetic device 92 and the formation 96 when the valve sleeve 36 reaches the first sealed position (FIG. 3A).

Upon reaching the first sealed position, energization of the electromagnetic device 92 will create sufficient magnetic force to hold the magnetic plate 96, and by connection the valve sleeve 36, from reciprocal movement for a predetermined amount of time (determined by the control program 66*a*) sufficient to permit return of the piston 22 to the piston pre-firing position (FIG. 3). Upon expiration of the predetermined amount of time controlled by the control program 66*a*, the electromagnetic device 92 is deenergized, releasing the valve sleeve 36 so that internal gases can be exchanged for the next operational combustion cycle, as described above.

Figure 5:
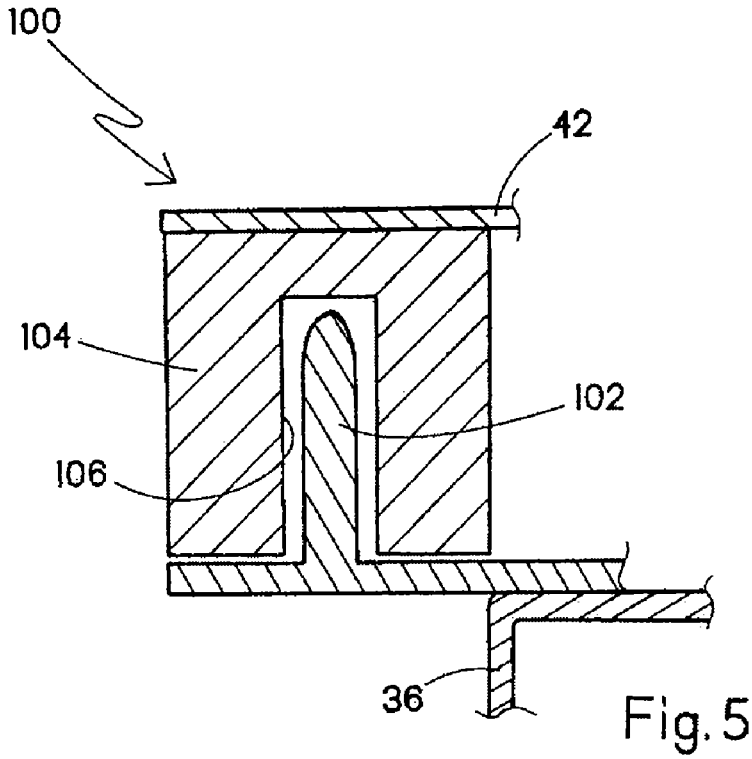
FIG. 5 is a schematic elevation of another alternate embodiment of the lockout system of FIG. 1 using another electromagnetic device.

Referring now to FIG. 5, another alternate embodiment of the tool 10 is provided in which the lockout device 10 is generally designated 100. Shared components with prior embodiments are designated with identical reference numbers. The valve sleeve 36 is provided with a generally axially extending pin 102 made of a rigid, magnetic material such as a durable metal. An electromagnetic device 104 is secured to a fixed position on the tool 10, such as on the power source 14, preferably on the cylinder head 42, however other locations are contemplated provided they remain in a fixed position relative to reciprocation of the valve sleeve 36. The electromagnetic device 104 is controlled by the control program 66*a* and is provided in a tubular or sleeve-like construction, defining an elongate passageway 106 dimensioned for matingly receiving the pin 102. Upon the valve sleeve 36 reaching the pre-firing position (FIG. 3A) and closing the chamber switch 44, the control program 66*a* energizes the electromagnetic device 104, creating sufficient magnetic force to hold the pin 102 in mating engagement and thus prevent the valve sleeve from moving reciprocally. As is the case with the prior embodiments, the control program 66*a* also initiates a timer (not shown) which determines the amount of time the device 104 is energized, corresponding to the amount of time needed for piston return. As such, the piston 22 is permitted sufficient time to return to the piston pre-firing position (FIG. 3) prior to the next combustion cycle event.

Figure 9:
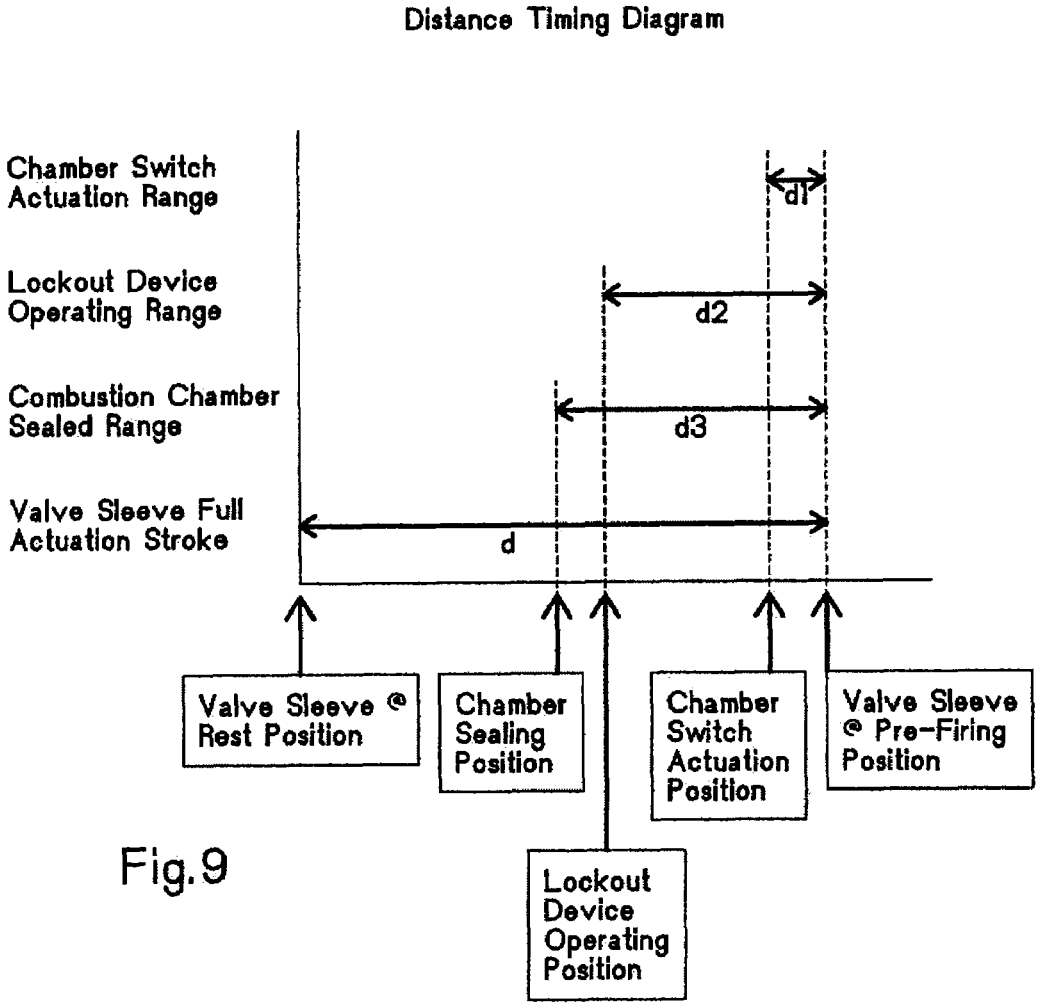
FIG. 9 is a distance timing diagram describing the relative distances of d, $d_1$, $d_2$ and $d_3$.

Referring again to FIGS. 2 and 3, and also to FIG. 9, it has been found that beneficial lockout device function is obtained when the valve sleeve 36 is permitted an amount of overtravel from the first sealed position to the pre-firing position and the lockout device 60 can prevent the valve sleeve from opening the combustion chamber 18 in that range. Furthermore, a distance $d_1$ is defined as the chamber switch actuation range, and also represents a portion of the valve sleeve travel after reaching the first sealed position and until the pre-firing position is reached. At the end of the travel of the valve sleeve 36, the chamber switch 44 is closed (FIG. 3). A distance $d_2$ (FIG. 3) is defined between the actuated position of the latch 64 and its contact point on the valve sleeve 36 when the valve sleeve is at the pre-firing position or full vertical limit of movement towards the cylinder head 42. Thus, the lockout device 60 is configured for automatically preventing the reciprocation of the valve sleeve 36 beyond the predetermined distance $d_2$ while the lockout device is actuated. A distance of travel of a point on the valve sleeve 36, typically the shoulder 80, between the first sealed position (FIG. 3A) and the pre-firing position (FIG. 3) defines a distance $d_3$.

To achieve the desired results of the present tool, it is preferred that $d_1$ is less than $d_2$, which is less than $d_3$. Referring to FIG. 9, $d_1$, $d_2$ and $d_3$ are functions of the total amount of displacement of the valve sleeve 36, represented by 'd'. This relationship assures that the combustion chamber 18 remains sealed while the lockout device 60 is actuated. This disposition of the lockout device 60 also allows the lockout device to be positioned closer to the open position of the combustion chamber 18, thus facilitating post combustion recharging of air for spent combustion gases within the combustion chamber. More specifically, it is preferred that $d_2$ is slightly less than $d_3$. Another benefit is reduced cycle times and reduced exposure to hot combustion gases. Also, with $d_1$ being less than $d_2$ and $d_3$, the control program 66*a* monitors if the user lifts the tool from the workpiece prematurely before a combustion cycle occurs, wherein the chamber switch 44 is permitted to open, signaling the control program to abort the combustion event, since the tool's position is not optimum for supporting a complete nail drive.

Figure 6:
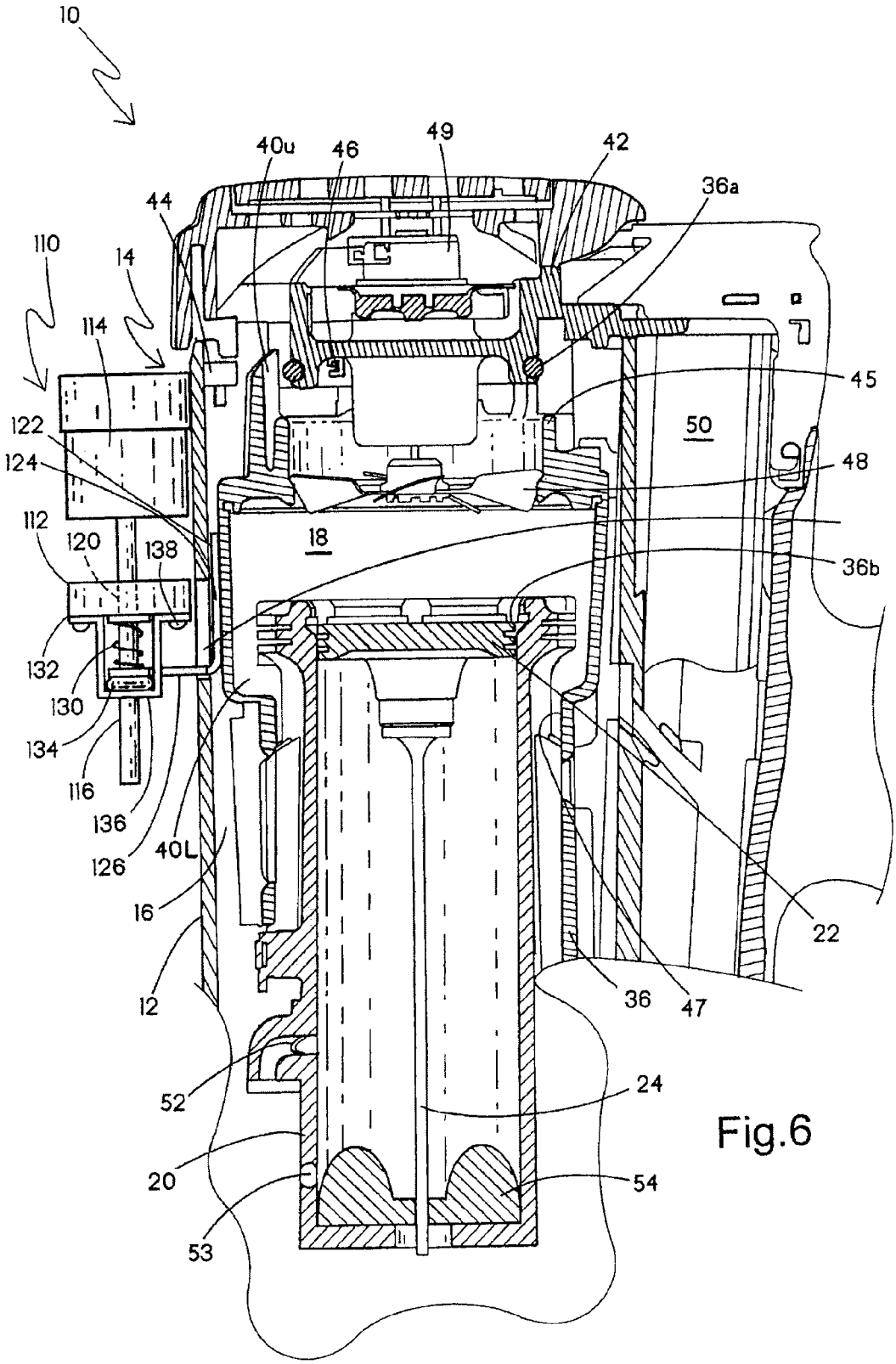
FIG. 6 is a fragmentary vertical cross-section of a third alternate embodiment of the tool of FIG. 1 shown in the rest position.
Figure 7:
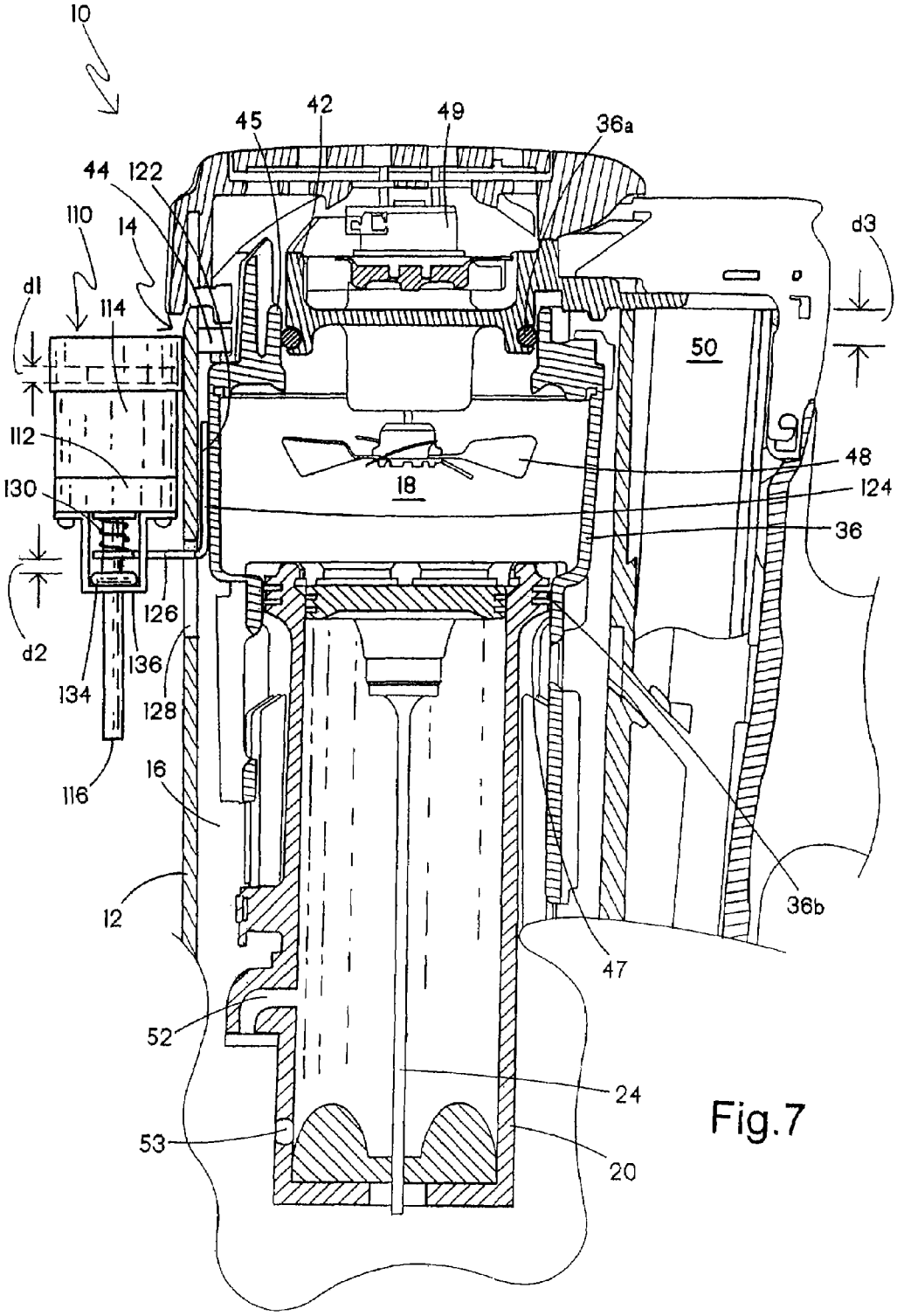
FIG. 7 is a fragmentary vertical cross-section of the alternate embodiment of the tool of FIG. 6 shown in the pre-firing position.
Figure 8:
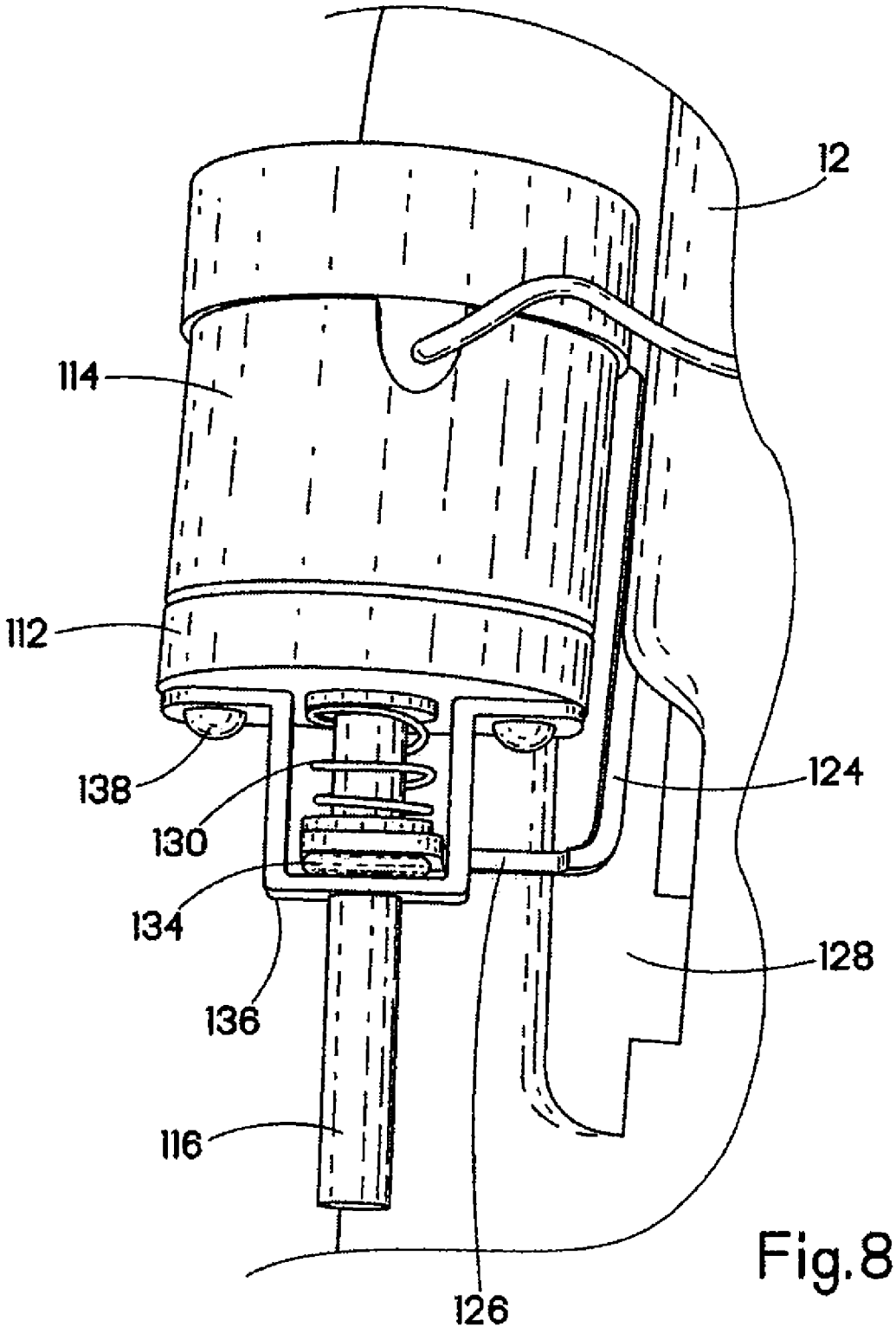
FIG. 8 is a fragmentary side elevation of the alternate embodiment of the tool of FIG. 6 shown in the post-firing position.

Referring now to FIGS. 6-8, another alternate embodiment of the tool 10 is shown, in which a lockout mechanism is generally designated 110 which is a variation of the embodiments 90 and 100. Generally, a magnetic plate 112 associated with the valve sleeve 36 prevents the valve sleeve from movement away from the cylinder head 42 to open the combustion chamber 18 when an electromagnetic device 114 is energized. As is the case in the lockout devices 90 and 100, the device 110 is configured for acting to limit the movement of the valve sleeve 36 for a predetermined period along an axis parallel to the movement of the valve sleeve.

As in the prior embodiments, the-electromagnetic device 114 is controlled by the control program 66*a*. In a variation from the embodiment of FIG. 5, the device 114 is provided with a depending alignment shaft 116. The magnetic plate 112 is associated with the valve sleeve 36 but is not in direct connection therewith. The magnetic plate 112 is configured for being magnetically attracted to and held in place when the electromagnetic device 114 is energized, and is provided with a throughbore 120 (shown hidden) which matingly engages the alignment shaft 116.

A generally "L" shaped bracket 122 has a long leg 124 attached to the valve sleeve 36, and a short leg 126 with an aperture (not shown) for also matingly engaging the alignment shaft 116. The housing 12 has a slot 128 dimensioned for accommodating the travel of the valve sleeve 36 from the rest position (FIG. 6) to the pre-firing position (FIG. 7). As seen in FIG. 6, the short leg 126 engages the alignment shaft 116 below the magnetic plate 112. A biasing element 130 such as a compression spring or the like is positioned on the alignment shaft 116 between the short leg 126 and an underside 132 of the magnetic plate 112.

A dampening element 134 such as a resilient doughnut-shaped rubber bushing or the like is disposed on the alignment shaft 116 below the short leg 126 and is held in place by a generally "U"-shaped retainer bracket 136 secured to the underside 132 of the magnetic plate 112. Preferably fasteners 138 secure the retainer 136 in place; however other known fastening technologies such as welding or chemical adhesives are contemplated.

In the embodiment 110, the distance $d_2$ is defined by the position of the bottom of the short leg 126, when the valve sleeve is in the pre-firing position (FIG. 7) and the upper surface of the dampening element 134. It will be seen that as the valve sleeve 36 travels beyond the first seal position, the magnetic plate 112 is moved into engagement with the electromagnetic device 114, and the chamber switch 44 is activated, providing for the control program 66*a* to energize the electromagnetic device and preventing the valve sleeve from movement to open the combustion chamber 18. As is the case with the lockout device embodiment 60 of FIGS. 2 and 3, as the valve sleeve 36 moves progressively from the first seal position to the pre-firing position, the lockout device 110 accommodates this overtravel distance. The short leg 126 progresses along the alignment shaft 116 against the biasing force of the spring 130. Upon reaching the pre-firing position (FIG. 7), the spring 130 is compressed and the short leg 126 has reached the upper limit of its travel.

Upon ignition or firing of the spark plug 46, as is known the piston 22 is forced down the cylinder 20. The user then typically lifts the tool 10 to move it to the next fastener position on the workpiece. Due to the permitted overtravel of the valve sleeve 36 relative to the cylinder head 42 as well as the lockout device 110, as the user lifts the tool, the short leg 126 is movable down the alignment shaft 116 and is protected from impact damage by the dampening element 134, which is compressible (FIG. 8). Since the retaining bracket 136 is fixed to the magnetic plate 118, the valve sleeve bracket short leg 126 compresses the dampening element 134 against the retaining bracket and cannot advance beyond this point until the electromagnet device 114 is de-energized by the control program 66*a*, and releases the magnetic plate. As a result, the valve sleeve 36 is prevented from retracting beyond a sealed position. Once the electromagnet device 114 de-energizes, the movement of the valve sleeve 36 and the valve sleeve bracket 122 will draw the magnetic plate 112, the spring 130 and the retaining bracket 136 retaining assembly towards the rest position. As is the case with the embodiment 60, in the lockout device 110, $d_1$ is less than $d_2$, which is less than $d_3$.

It will be understood that in the embodiment 110, the pin and sleeve arrangement of the alignment shaft 116 may alternatively be fixed to the magnetic plate 112 instead of the electromagnetic device 114. Also, while only one lockout assembly 90, 100, 110 is illustrated per tool 10, the number and varied positioning of additional assemblies is contemplated depending on the application.

While a particular embodiment of the present combustion chamber control for a combustion-powered fastener-driving tool has been described herein, it will be appreciated by those skilled in the art that changes and modifications may be made thereto without departing from the invention in its broader aspects and as set forth in the following claims.

The invention claimed is:

1. A combustion-powered fastener-driving tool, comprising:

a combustion-powered power source including a cylinder head and a combustion chamber defined by said cylinder head, a valve sleeve, a cylinder and an upper surface of a reciprocating piston;

said valve sleeve reciprocable relative to said cylinder head between a rest position and a pre-firing position;

said valve sleeve having a range of positions between a first sealing position in which said combustion chamber is closed, and said pre-firing position in which said valve sleeve is prevented from further movement towards said cylinder head;

a lockout device mounted to the tool and having an actuated position configured for preventing movement away from said cylinder head of said valve sleeve beyond said first sealed position to open said combustion chamber; and said lockout device including a fixed electromagnetic component secured to said power source and a magnetically attractable movable component, being movable relative to said fixed component and having a first portion secured to said valve sleeve for common reciprocal movement and a second portion movable relative to said first portion and said valve sleeve, wherein after magnetic engagement of said fixed electromagnetic component and said second portion of said movable component, said valve sleeve, being movably connected to said second portion of said movable component, is movable from said first sealed position to said pre-firing position.

2. The tool of claim 1, wherein said lockout device further includes a biasing element between said movable component and said valve sleeve for exerting a biasing force against said valve sleeve.

3. The tool of claim 1, wherein said moveable component moves along an alignment shaft connected to said fixed electromagnetic component.

4. A combustion-powered fastener-driving tool, comprising:

a combustion-powered power source including a combustion chamber defined by a cylinder head, a valve sleeve, a cylinder and an upper surface of a reciprocating piston;

a valve sleeve reciprocable relative to said cylinder head between a rest position and a pre-firing position;

said valve sleeve having a range of sealed positions between a first sealing position and said pre-firing position;

a lockout device configured for automatically preventing movement away from said cylinder head of said valve sleeve beyond said first sealed position until a piston in said power source returns to said pre-firing position, said lockout device including an electromagnet secured to said tool relative to said combustion power source;

a magnetic plate connected to and movable with said valve sleeve relative to said electromagnet; said magnetic plate further being slidable relative said valve sleeve so that movement of said valve sleeve toward said pre-firing position is accommodated after engagement of said magnetic plate with said electromagnet; and a bracket secured to said valve sleeve for common movement and connected through a biasing element to said magnetic plate for moving said magnetic plate towards said electromagnet upon movement of said valve sleeve toward said first seal position, and said biasing element biasing said bracket a distance from said magnetic plate until said valve sleeve reaches said first seal position.

5. The tool of claim 4 wherein said biasing element biases said bracket from said magnet plate.

6. The tool of claim 4 further including a dampening element.

7. The tool of claim 4 wherein said electromagnet includes a depending alignment shaft, and said bracket and said magnetic plate are slidably disposed on said shaft.

8. The tool of claim 7 further including a retainer secured to said magnetic plate for retaining said bracket in operational relationship to said magnet plate.

9. The tool of claim 8 further including a dampening element.

10. A combustion-powered fastener-driving tool, comprising:

a combustion-powered power source;

a valve sleeve reciprocal relative to said power source between a rest position and a pre-firing position;

said valve sleeve having a distance $d_3$ between a first sealing position where said valve sleeve engages combustion chamber seals, and said pre-firing position;

said tool having a chamber switch turned on by the movement of said valve sleeve having a distance $d_1$ between a rest position and an actuation position; and a lockout device configured for automatically preventing movement of said valve sleeve below said lockout device and away from said combustion chamber beyond a predetermined distance $d_2$ while the lockout device is actuated and a combustion chamber is sealed;

wherein $d_1$ is less than $d_2$ which is less than $d_3$, and wherein upon post firing release of said tool from a workpiece, after said chamber switch is turned off, said combustion chamber remains sealed as said valve sleeve travels said distance $d_2$, which provides additional time for maintaining a vacuum in said combustion chamber to enhance the return of a piston before said combustion chamber is opened.

11. A combustion-powered fastener-driving tool, comprising:

a combustion-powered power source including a cylinder head and a combustion chamber defined by said cylinder head, a valve sleeve, a cylinder and an upper surface of a reciprocating piston;

said valve sleeve reciprocable relative to said cylinder head between a rest position and a pre-firing position;

said valve sleeve having a range of positions between a first sealing position in which said combustion chamber is closed, and said pre-firing position in which said valve sleeve is prevented from further movement towards said cylinder head;

a lockout device associated with said power source and having an actuated position configured for preventing-movement away from said cylinder head of said valve sleeve beyond said first sealed position to open said combustion chamber, but permitting movement of said valve sleeve from said first sealed position to said pre-firing position until said piston returns to a piston pre-firing position post combustion; and said lockout device includes an electromagnetic device configured for acting to limit the movement of said valve sleeve away from said cylinder head for a predetermined period, said device configured for operating along an axis parallel to the movement of said valve sleeve, wherein said valve sleeve includes at least one magnetically attractive contact formation, said lockout device is electromagnetic and, upon actuation is configured for magnetically engaging said at least one magnetically attractive contact formation for preventing movement of said valve sleeve from said first sealed position to said rest position.

* * * * *